United States Patent [19]

Sokol et al.

[11] 4,093,189

[45] June 6, 1978

[54] APPARATUS FOR CONTINUOUS PREPARATION OF A SUSPENSION

[76] Inventors: Iosif Borisovich Sokol, bulvar matrosa Zheleznyaka, 11[a], kv. 79; Nina Vladimirovna Katysheva, Angarskaya ulitsa, 49, korpus 2, kv. 167; Vladimir Mikhailovich Belyaev, Angarskaya ulitsa, 59, kv. 23, all of Moscow; Dmitry Danilovich Logvinenko, ulitsa Kalinina, 5, kv. 5; Ekaterina Alexandrovna Morozko, ulitsa K.Libknekhta, 22, both of Poltava; Boris Alexeevich Pepelin, Bulatnikovsky proezd, 10, kv. 746; Viktor Alexeevich Prudovoi, Snaiperskaya ulitsa, 6, korpus 3, kv. 40, both of Moscow, all of U.S.S.R.

[21] Appl. No.: 733,383

[22] Filed: Oct. 18, 1976

[51] Int. Cl.[2] ..... B01F 7/00; B01F 15/00

[52] U.S. Cl. .....366/156; 366/273

[58] Field of Search ..... 259/7, 8, 18–21, 259/36–44, 97, DIG. 20, DIG. 30; 204/186, 190, 222

[56] References Cited

U.S. PATENT DOCUMENTS

| | | | |
|---|---|---|---|
| 3,026,406 | 3/1962 | van Den Blink | 259/28 |
| 3,887,166 | 6/1975 | Van Ginneken | 259/7 |
| 3,986,705 | 10/1976 | Nauta | 259/8 |

*Primary Examiner*—Leonard D. Christian

*Attorney, Agent, or Firm*—Lackenbach, Lillina & Siegel

[57] ABSTRACT

The apparatus comprises a housing mounted on a framework and accommodating therein an annular inductor encircling a mixing chamber and adapted to create a rotating electromagnetic field in said chamber. Ferromagnetic particles are present in the mixing chamber. The mixing chamber communicates from above with a charging device including a feed screw continuously supplying solid components of the suspension directly into the chamber; liquid components of the suspension are fed into the chamber through the hollow shaft of the feed screw. Connected from below to the mixing chamber is one end of an S-shaped conduit acting as a discharge device. The apparatus provides rapid and effective mixing of the components of the suspension.

3 Claims, 2 Drawing Figures

APPARATUS FOR CONTINUOUS PREPARATION OF A SUSPENSION

Figures 1, 2:
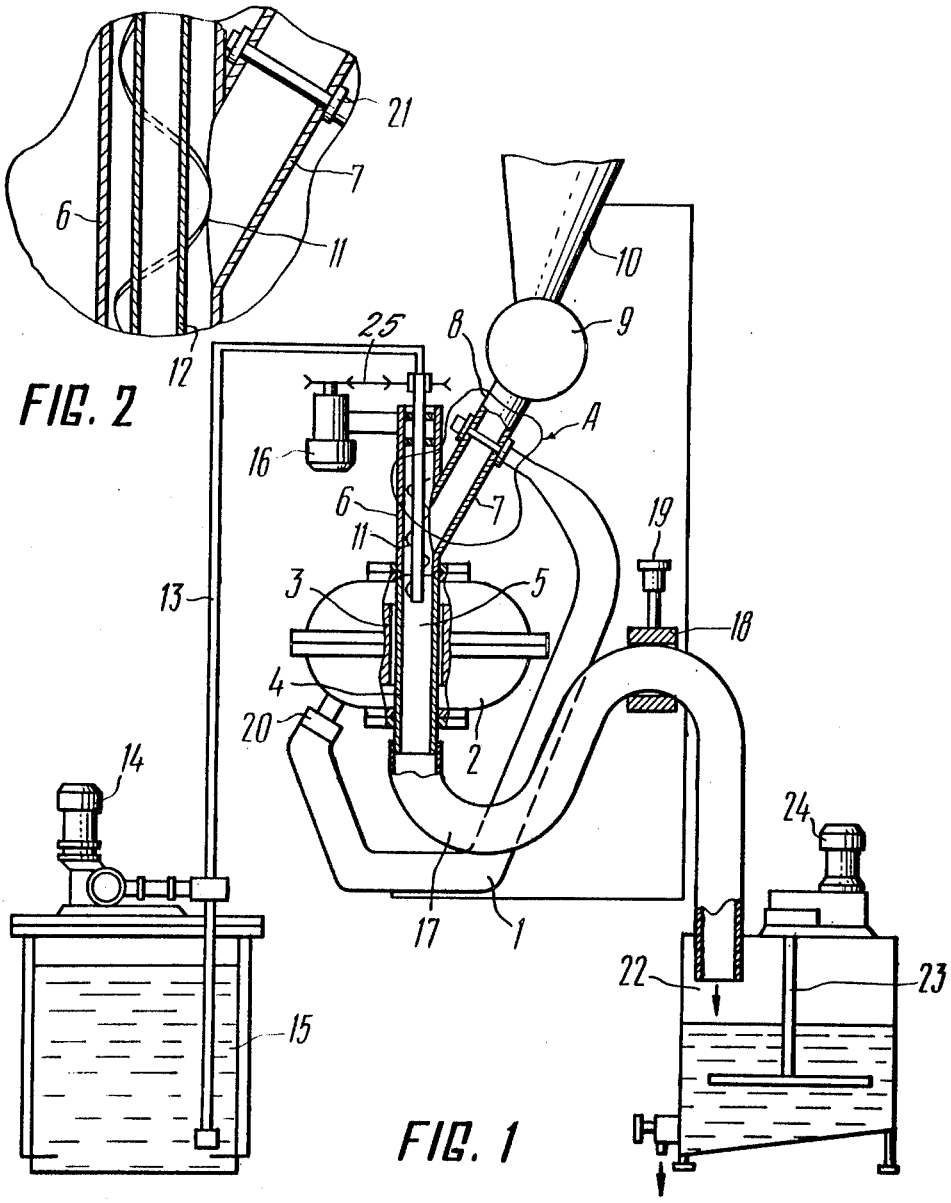

The present invention relates to apparatus for continuous preparation of a suspension by mixing its liquid and solid components in a turbulent stream passing through a bed of ferromagnetic particles moving in an electromagnetic field of an inductor.

The apparatus can be utilized to utmost effectiveness for continuous preparation of a suspension used for production of shell moulds employed in investment casting processes.

It is common knowledge that the quality and precision of the castings produced by the investment casting technique are significantly influenced by the quality of the suspension used for production of the shell moulds.

Further, the quality of the suspension depends on the intensity of the mixing of its components.

An important factor under series production conditions is the duration of the suspension preparation cycle.

Experience has proven that the intensity of the mixing of the liquid and solid components of a suspension is greater in apparatus provided with mixing chambers with ferromagnetic particles than in apparatus incorporating mixing members of the mechanical type, which are also used in the technology of investment casting.

One known continuous-action apparatus, for preparation of suspensions and emulsions in a turbulent bed of ferromagnetic particles, includes a mixing chamber, a plurality of dispersion chambers of a tubular form arranged about and parallel with the mixing chamber and communicating therewith at the side opposite to the discharge side of the chamber, an inductor adapted to create a rotating electromagnetic field which encircles from the outside the dispersion chambers, a device for feeding or charging the components of the suspension or of the emulsion, as the case may be, and a device for discharge of the end product. The mixing chamber and the dispersion chambers receive therein ferromagnetic particles which are driven through a turbulent motion by the action of the rotating electromagnetic field and, while being thus driven, effect the dispersion and mixing of the components of the suspension or of the emulsion.

The charging device in this known apparatus consists of two branch pipes one of which is connected to the solid component feed line and the other is connected to the liquid component feed line. The components of the suspension are directed by these branch pipes into the zone of the mixing chamber, which is beyond the confines of the electromagnetic field of the inductor.

The discharge device of the abovedescribed known apparatus is made in the form of a manifold communicating with each one of the dispersion chambers.

The above-described known apparatus is preferably employed for preparation of either emulsions or low-concentration suspensions. Experiments and practical experience alike have shown that the structure of the known apparatus would not enable it to be used for preparation of concentrated suspensions, i.e. suspensions wherein the quantity of solid components is relatively great in comparison with the quantity of liquid components. On the other hand, such high-concentration suspensions are nowadays broadly used in various productions, e.g. in investment casting wherein the content of the solid pulverized component in a suspension for making shell moulds amounts to 65 percent by weight and even more.

It is also commonly known that in the process of preparing a suspension the components making up this suspension should be mixed with the highest intensity at the opening stage of the mixing operation. This is particularly true in a case of preparation of a high-concentration suspension to prevent caking and clotting and to create the necessary conditions for the commencing of a chemical reaction, e.g. the conditions required by the reaction of hydrolysis of ethylsilicate, which is to take place during preparation of a suspension in the technology of investment casting.

However, such conditions cannot be ensured in the above-described known apparatus, wherein the overall structure is such that the mixing chamber is practically screened from the electromagnetic field by the plurality of dispersion chambers which results in a lower intensity of the turbulent motion of the ferromagnetic particles within the mixing chamber, whereas it is the mixing chamber into which the components are directed in the first place. Moreover, the incorporation in the known apparatus of the plurality of dispersion chambers made in the form of tubes of a relatively small diameter increases the hydraulic flow resistance of the entire apparatus, and consequently results in an obstructed passage of high-concentration suspensions, which usually are of a relatively high viscosity, through the apparatus. An attempt to eliminate the last-mentioned disadvantage by increasing the diameters of the tubes is ill-advisable, since in this case the diameter of the electric inductor producing the rotating magnetic field if to be significantly increased, and one should remember that the amount of electric power consumed by an inductor is proportional to the cube of its diameter.

Further still, the device for charging the components of emulsions or suspensions into the mixing chamber of the afore-mentioned known apparatus is made in the form of a conduit with a branching portion at the receiving end thereof, the different components of an emulsion or suspension being fed into the conduits through these branches, are directed by the conduit into the mixing chamber. A disadvantage of this structure of the charging device in cases where it is used for preparation of suspensions is the fact that the solid component or components become moistened with the liquid one or ones already within this conduit, which practically results in caking and clotting, and more often that not would even result in clogging of the conduit, particularly when high-concentration suspensions are being prepared.

And, finally, a disadvantage of the known apparatus devices from the fact that the device for discharging the prepared suspension in this apparatus is made in the form a rigidly fixed manifold, which would not enable regulation of the level to which the mixing and dispersion chambers are filled. This, in its turn, practically leads to the level of the suspension being prepared rising about the mixing zone actively influenced by the electromagnetic field, and, consequently, in a settling and segregation zone being eventually created; furthermore, it is this zone into which the freshly charged components get in the first place. Once again, it might result in caking and even clogging of the entire system.

It is the main object of the present invention to provide an apparatus for continuous preparation of a suspension, which should be of a higher capacity than the hitherto known apparatus for similar applications.

It is also an important object of the present invention to improve the quality of a suspension prepared in the herein disclosed apparatus, by intensifying the mixing of the solid and liquid components of the suspension.

It is still another object of the present invention to prolong the service life of the apparatus and to step up the reliability of its performance.

These and other objects are attained by providing an apparatus for continuous preparation of a suspension, comprising a housing mounted on a framework and accommodating therein an inductor of a generally annular shape encircling the body of a mixing chamber receiving therein ferromagnetic particles, the inductor being adapted to create within this chamber a rotating electromagnetic field, the mixing chamber communicating at the inelt thereof with a charging device made in the form of a tube with a branch pipe connectable to a feed line of the solid component of the suspension to be made and with a tubular member connectable to a feed line of the liquid component of the suspension, the body of the mixing chamber at the outlet thereof communicating with a discharge device, in which apparatus, in accordance with the invention, the tube with the branch pipe of the charging device, mounted at the top of the housing of the apparatus, receives therein a feed screw for feeding the solid component of the suspension directly into the mixing chamber, the feed screw being fixed on a hollow shaft acting as the said tubular member establishing communication between the mixing chamber and a flexible conduit which acts as the feed line of the liquid components of the suspension to be made, the body of the mixing chamber having connected thereto at the bottom thereof one end of an S-shaped conduit acting as said discharge device.

An apparatus having a charging device of the herein disclosed type provides for feeding the liquid and solid components of a suspension directly into the active zone of the electromagnetic field within the mixing chamber, which intensifies the mixing of the components of the suspensions and promotes a chemical reaction therebetween.

Furthermore, the disclosed structure eliminates the pre-moistening of the solid components with the liquid ones, which precludes caking and clotting. Moreover, the disclosed discharge device provides for enhanced normal operation of the apparatus and dependable delivery of the prepared mixture from the mixing chamber.

It is expedient that the said discharge device should comprise a flexible S-bent conduit, its free end portion being secured with provisions for vertical adjustments.

Such vertical adjustments of the end portion of the discharge device enable maintenance of a required level of the suspension within the mixing chamber of the apparatus, to correspond to the content of the solid and liquid components therein.

It is further expedient that the branch pipe of the charging device should be connected to the feed line of the solid component through a coupling providing for rotation of the housing of the apparatus about the longitudinal axis of this branch pipe, the framework in this case having mounted thereon a pivot means by which the housing of the apparatus is connected with the framework.

In this way it becomes possible to control the head of the suspension in the mixing chamber by adjustably inclining the housing of the apparatus, by means of rotating this housing about the longitudinal axis of the branch pipe of the charging device.

The herein disclosed apparatus for continuous preparation of a suspension, according to the invention, offers a reliable performance and prolonged service life. Moreover, it is structurally simple and, which is even more important, ensures rapid and intense mixing of the liquid and solid components of a suspension.

For the present invention to be better understood, described hereinbelow is an embodiment of the invention, with reference being had to the accompanying drawings, wherein:

FIG. 1 is a partly broken away side elevational view of an apparatus embodying the invention; and FIG. 2 is an enlarged detail view of the area A in FIG. 1.

In the drawings, the apparatus for continuous preparation of a suspension comprises a framework 1 (FIG. 1) supporting thereon a housing 2 having a spherical shape. The internal space of the housing 2 is filled with transformer oil. The housing 2 of the apparatus encloses therein an electrical inductor 3 for creating a rotating electromagnetic field. The inductor 3 may be made in the form of the stator structure of an asynchronous electric motor. The inductor 3 has an annular shape and encircles the body 4 of a mixing chamber 5 filled with ferromagnetic particles (not shown in the drawing). Connected from above to the mixing chamber 5 is a charging device made in the form of a tube 6 (FIG. 2) with a branch pipe 7 connectable to a feed line 8 (FIG. 1) of the solid component, which is connected through a metering device 9 to a hopper 10.

The tube 6 accommodates therein a rotatable feed screw 11 mounted on a hollow shaft 12 (FIG. 2) which acts as the tubular member establishing communication between the mixing chamber 5 and a flexible conduit 13 (FIG. 1) connected through a pump 14 to a vessel 15 containing a supply of the liquid component of the suspension to be prepared. The feed screw 11 is rotatable by a drive 16 by means of a V-belt drive 25.

The discharge device of the presently described embodiment comprises a generally S-shaped conduit 17, with the "S" turned through 90°, one end portion or elbow of this conduit being connected from below to the outlet of the body 4 of the mixing chamber 5. In the embodiments being described, the discharge device 17 is a flexible conduit of which the other free end portion or elbow is suspended from a bracket 18 provided with a vertical adjustment mechanism 19, the vertical adjustment being essential for maintaining a required level of the suspension in the mixing chamber 5.

To control the head of the suspension in the mixing chamber 5, the housing 2 of the apparatus is mounted on the framework 1 by means of a pivot 20, while the branch pipe 7 of the charging device is connected with the feed line 8 of the solid component of the suspension by a swivel coupling 21 (FIG. 2) which permits rotation of the housing 2 (FIG. 1) of the apparatus about the longitudinal axis of the branch pipe 7 which is axially aligned with the feed line 8.

To receive the prepared suspension, the apparatus is provided with a tank 22 with an agitator 23 operatively connected to a drive 24.

The apparatus for continuous preparation of a suspension operates as follows.

The solid components of the suspension to be prepared are fed from the hopper 10 (FIG. 1) through the metering device 9 and the feed line 8 into the inlet branch pipe 7 of the charging device, which directs them into the tube 6 where the feed screw 11 conveys them into the mixing chamber 5. The liquid components of the suspension are fed from the vessel 15 by the pump 14 via the flexible conduit 13 and the hollow shaft 12 (FIG. 2) of the feed screw 11 into the mixing chamber 5 (FIG. 1). Depending on the number of the liquid components, several such vessels 15 can be employed. The charging device according to the invention ensures that the components of the suspension to be prepared are fed directly into the mixing chamber 5, wherein they immediately enter the area of action of the electromagnetic field created by the inductor 3. In this way there is completely eliminated the pre-moistening of the solid components, so that no cakes or clots are formed. Within the mixing chamber 5 there is effected intense mixing of the liquid and solid components of the suspension under the action of the ferromagnetic particles moving in the field created by the inductor 3. At the same time, there are created favorable conditions for a chemical reaction between the components of the suspension.

The required level of the suspension within the mixing chamber 5 is maintained by vertically adjusting the free end portion or elbow of the S-shaped conduit 17 to a corresponding level. Thus, depending on the ratio of the solid and liquid components of the suspension within the mixing chamber 5, there is controlled the exact position of the level of the suspension by adjusting vertically the free end or elbow of the S-shaped conduit 17 with the vertical adjusting mechanism 19. Via the discharge device in the form of the flexible conduit 17 the prepared suspension is delivered into the receptacle 22 for this suspension, wherein it is agitated by the agitator 23 rotated by the drive 24.

Experimental tests carried out with a pilot model of the herein disclosed apparatus showed that it was preparing a high-quality suspension, and that the preparation process took considerably less time, e.g. about one hundredth, than in the case of standardly used mechanical mixers.

What is claimed is:

1. An apparatus for continuous preparation of a suspension, comprising: a framework; a housing mounted on said framework; an inductor for producing a rotating electromagnetic field having a generally annular shape and being accommodated within said housing; a mixing chamber having a body receiving therein ferromagnetic particles and encircled by said inductor; a flexible conduit; a rotatable hollow shaft, one end of which communicates via said flexible conduit with a supply of a liquid component of the suspension to be prepared and the other end of which communicates with said body of said mixing chamber; a feed line; a tube having a branch pipe, one end of said branch pipe communicating via said feed line with a supply of a solid component of the suspension to be prepared, the other end of said branch pipe communicating via said tube with said body of said mixing chamber, said hollow shaft being accommodated inside said tube; a feed screw mounted on said hollow shaft and being inside said tube; means for effecting rotation of the feed screw mounted on said housing; a discharge device including an S-shaped conduit having one end connected to a bottom of said body of the mixing chamber.

2. An apparatus as set forth in claim 1, wherein said S-shaped conduit is flexible and the other end of said S-shaped conduit is provided with means for vertical adjustment.

3. An apparatus as set forth in claim 1, further comprising a coupling wherein the branch pipe is connected to the feed line through said coupling thus permitting rotation of said housing about the longitudinal axis of the branch pipe, said framework being provided with a corresponding pivot connected to said housing.

* * * * *